US005490954A

United States Patent [19]

van der Hoeven et al.

[11] Patent Number: 5,490,954

[45] Date of Patent: Feb. 13, 1996

[54] DETERGENT COMPOSITION OR COMPONENT CONTAINING ANIONIC SURFACTANT AND PROCESS FOR ITS PREPARATION

[75] Inventors: Frans A. van der Hoeven; Christophe Joyeux, both of Rotterdam, Netherlands

[73] Assignee: Lever Brothers Company, Division of Conopco, Inc., New York, N.Y.

[21] Appl. No.: 265,285

[22] Filed: Jun. 24, 1994

[30] Foreign Application Priority Data

Jul. 5, 1993 [GB] United Kingdom ..... 9313878

[51] Int. Cl.[6] ..... C11D 17/06; C11D 1/12; C11D 3/10

[52] U.S. Cl. ..... 252/550; 252/89.1; 252/174; 252/174.25; 252/549; 252/558; 252/174.14

[58] Field of Search ..... 252/89.1, 174.14, 252/174.25, 549, 550, 558

[56] References Cited

U.S. PATENT DOCUMENTS

| | | | |
|---|---|---|---|
| 4,970,017 | 11/1990 | Nakamura et al. | 252/174.13 |
| 4,999,138 | 3/1991 | Nebashi et al. | 252/543 |

FOREIGN PATENT DOCUMENTS

| | | |
|---|---|---|
| 0270240 | 10/1986 | European Pat. Off. . |
| 0229671 | 7/1987 | European Pat. Off. . |
| 0342917 | 11/1989 | European Pat. Off. . |
| 0384070 | 8/1990 | European Pat. Off. . |
| 0420317 | 4/1991 | European Pat. Off. . |
| 0439316 | 7/1991 | European Pat. Off. . |
| 0460925 | 12/1991 | European Pat. Off. . |
| 0506184 | 9/1992 | European Pat. Off. . |
| 0521635 | 1/1993 | European Pat. Off. . |
| 1429143 | 3/1976 | United Kingdom . |
| 1473202 | 5/1977 | United Kingdom . |
| 1473201 | 5/1977 | United Kingdom . |
| WO94/07990 | 4/1994 | WIPO . |

OTHER PUBLICATIONS

International Search Report in International Patent Application No. PCT/EP 94/01856.
Abstract of JP 01020298. Jan. 24, 1989.
Abstract of JP 02169696. Jun. 29, 1990.
Abstract of WO94/01526. Jan. 20, 1994.
Abstract of WO 94/07990. Apr. 11, 1994.

*Primary Examiner*—Margaret Einsmann
*Attorney, Agent, or Firm*—Rimma Mitelman

[57] ABSTRACT

A free-flowing granular detergent composition or component having a bulk density of at least 550 g/liter comprises an anionic surfactant of which the acid form is a liquid at ambient temperature, preferably primary alcohol sulphate and/or alkylbenzene sulphonate; zeolite; and alkali metal, preferably sodium, carbonate. The level of sodium carbonate is 2–12 wt % when the anionic surfactant is wholly primary alcohol sulphate, otherwise 2–25 wt %. The compositions have lower levels of carbonate and higher surfactant loadings than previously disclosed materials, without loss of powder properties. The materials are preferably prepared by a granulation process involving in-situ neutralisation of anionic surfactant acid by carbonate in a high-speed mixer/granulator.

6 Claims, No Drawings

DETERGENT COMPOSITION OR COMPONENT CONTAINING ANIONIC SURFACTANT AND PROCESS FOR ITS PREPARATION

TECHNICAL FIELD

The present invention relates to a granular free-flowing detergent composition or component of high bulk density, containing a high level of anionic surfactant and also containing zeolite and alkali metal carbonate, and to its production by an in-situ neutralisation process.

BACKGROUND AND PRIOR ART

Recently there has been considerable and increasing interest within the detergents industry in the production of detergent powders having a high bulk density, and these are tending to supersede the traditional porous spray-dried powders. High bulk density powders may be made either by post-tower densification of spray-dried powder, or by wholly non-tower routes involving dry-mixing, agglomeration, granulation and similar processes.

Detergent powders of high bulk density containing anionic surfactants may be prepared by processes involving the neutralisation of a liquid acid precursor of an anionic surfactant with a solid water-soluble alkaline inorganic material, for example, sodium carbonate. This step may be carried out in the presence of other ingredients of the desired final composition, for example, detergency builders: a so-called in-situ neutralisation process. Such a process may be carried out in a batch or continuous high-speed mixer/densifier, although subsequent process steps are generally required to arrive at the desired granular product. A number of such processes is disclosed in the art.

EP 420 317A (Unilever) discloses a process for the preparation of granular detergent compositions and components of high bulk density, which comprises reacting a liquid precursor of an anionic surfactant with a solid water-soluble alkaline inorganic material in a high-speed mixer/densifier, for example, a Lödige (Trade Mark) CB30 Recycler; treating the material in a moderate-speed densifier/granulator, for example, a Lödige Ploughshare (Trade Mark); and finally drying and/or cooling the material, for example, in a fluidised bed. In principle, the process may be used to prepare compositions containing5 to 60 wt % detergency builder, 5 to 25 wt % sodium carbonate, 5 to 40 wt % anionic surfactant, and optional soap and nonionic surfactant. The compositions exemplified contain 36 to 46 wt % builder (zeolite A), 13.3 to 16.6 wt % sodium carbonate, and 13.6 to 23.3 wt % anionic surfactant, plus various minor ingredients.

EP 506 184A (Unilever) discloses a single-step process for the continuous preparation of a granular detergent composition or component, wherein 20 to 45 wt % of a liquid acid precursor of an anionic surfactant (preferably primary alcohol sulphate) and at least an equivalent amount of a solid water-soluble alkaline inorganic material (preferably sodium carbonate) are continuously fed into a high-speed mixer/densifier, together with sufficient water for the neutralisation process. In this process the detergent material remains throughout the process in particulate or granular form, and no further processing steps are required to obtain material of the required particle size.

Other desired ingredients such as detergency builders may be fed in additional to the alkaline material. In principle the process may be used to prepare granular compositions containing 20 to 50 wt % builder, 5 to 70 wt % sodium carbonate, 20 to 45 wt % anionic surfactant, plus optional soap and nonionic surfactant. The compositions exemplified contain zeolite A builder (25 to 32 wt %), sodium carbonate (16 to 48 wt %), and primary alcohol sulphate (25 to 32 wt %). No example in which the builder is zeolite contains more than 32 wt % anionic surfactant, but other examples in which the builder is calcite plus carbonate contain anionic surfactant (alkylbenzene sulphonate in this case) at levels of 39.2 to 39.5 wt %, and it is stated that the calcite/carbonate builder system enables higher surfactant levels to be attained.

The prior art compositions all contain sodium carbonate, at levels of at least 13.3 wt %. The presence of sodium carbonate was considered essential in order to obtain a granule that has sufficiently low friability to be handled readily in the factory. The sodium carbonate is known to provide nucleation sites for crystallisation and hence to play an important part in powder structuring. However, its presence limits the amount of anionic surfactant that can be carried, and limits formulation freedom in that less space is available for other ingredients; high alkalinity may also be undesirable in products intended for washing delicate fabrics, or for washing by hand.

It has now been found that in a zeolite/sodium carbonate/anionic surfactant granule, the carbonate level may be lowered much further than was previously thought, especially when the anionic surfactant is primary alcohol sulphate (PAS), without the penalty of unacceptable friability, thus allowing extremely high anionic surfactant loadings to be achieved.

Particularly high anionic surfactant levels may be attained when the zeolite is zeolite P having a silicon to aluminium ratio not exceeding 1.33 (zeolite MAP) as disclosed in EP 384 070A (Unilever).

Granules based on zeolite MAP have been found also to have an additional advantage over similar granules based on conventional zeolite A in that they also disperse more readily and rapidly in water.

EP 521 635A (Unilever) relates to the use of zeolite MAP as a highly efficient carrier for liquid detergent ingredients, especially nonionic surfactants. The use of zeolite MAP to prepare high bulk density agglomerates is disclosed, containing in principle from 15 to 40 wt % of liquid active ingredient (for example, low-HLB nonionic surfactant), and an agglomerate containing 39 wt % nonionic surfactant is specifically disclosed.

DEFINITION OF THE INVENTION

The present invention provides a free-flowing granular detergent composition or component having a bulk density of at least 550 g/liter comprising: (a) from 33 to 55 wt % of anionic surfactant of which the acid form is liquid at ambient temperature, (b) from 20 to 50 wt % (anhydrous basis) of zeolite, (c) from 2 to 25 wt % of alkali metal carbonate, provided that when the anionic surfactant consists wholly of primary alcohol sulphate the amount of alkali metal carbonate is from 2 to 12 wt %.

The invention further provides a process for the preparation of the granular detergent composition or component, which includes the step of continuously feeding appropriate amounts of a liquid acid precursor of an anionic surfactant (a), zeolite (b), a greater than equivalent amount of sodium carbonate (c), and sufficient water or alkali metal hydroxide solution for the neutralisation reaction, into a high-speed mixer/densifier.

DETAILED DESCRIPTION OF THE INVENTION

The Granular Detergent Composition or Component

The granular material which is the first subject of the invention is a free-flowing material of high bulk density containing zeolite, a high level of anionic surfactant, and a controlled level of alkali metal carbonate.

This material may be regarded or used as a detergent composition in its own right, but its main utility is as a component to which other components, for example, nonionic surfactant and bleach ingredients, may subsequently be mixed, to give a fully formulated product. The granular material of the invention possesses useful porosity which enables it to carry mobile ingredients such as liquid nonionic surfactant.

The bulk density of the material may advantageously range from 550 to 800 g/liter. Higher bulk densities are at the expense of porosity and carrying capacity, and are therefore not preferred.

The Zeolite

The zeolite present in the granular material of the present invention is a crystalline aluminosilicate as described, for example, in GB 1 473 201 and GB 1 473 202 (Henkel) and GB 1 429 143 (Procter & Gamble).

The zeolite A used commercially in detergent compositions may be used in the granular material of the invention. According to a preferred embodiment, however, the granular material contains zeolite MAP as disclosed in EP 384 070A (Unilever). Zeolite MAP is defined as a crystalline aluminosilicate of the zeolite P type having a silicon to aluminium ratio not exceeding 1.33, preferably not exceeding 1.15, and more preferably not exceeding 1.07.

Preferred zeolite MAP for use in the present invention is especially finely divided and has a $d_{50}$ (as defined below) within the range of from0.1 to 5.0 microns, more preferably from 0.4 to 2.0 microns and most preferably from 0.4 to 1.0 microns. The quantity "$d_{50}$" indicates that 50 wt % of the particles have a diameter smaller than that figure, and there are corresponding quantities "$d_{80}$", "$d_{90}$" etc. Especially preferred materials have a $d_{90}$ below 3 microns as well as a $d_{50}$ below 1 micron.

The granular material of the invention preferably comprises from 30 to 50 wt % of zeolite, more preferably from 30 to 40 wt %. These are percentages relating to the (notional) anhydrous material.

The Anionic Surfactant

The amount of anionic surfactant present is from 33 to 55 wt %, preferably from 40 to 50 wt %. These very high levels, especially above 40 wt %, have not been achieved previously without loss of powder properties and/or unacceptable dispersion and dissolution behaviour.

Any anionic surfactant of which the acid form is liquid at ambient temperature may be used. Such anionic surfactants are generally sulphates or sulphonates. Suitable anionic surfactants include primary and secondary alcohol sulphates, alkylbenzene sulphonates, secondary alkane sulphonates, alpha and internal olefin sulphonates, fatty acid ester sulphonates, and dialkyl sulphosuccinates.

Preferably, the anionic surfactant is selected from primary alcohol sulphate (hereinafter PAS), alkylbenzene sulphonate (hereinafter LAS), and mixtures of these.

The invention is of especial benefit when the anionic surfactant is PAS, when extremely high surfactant loadings have been achieved in combination with excellent powder properties and good dispersion and dissolution behaviour.

The PAS may have a chain length in the range of $C_8$ to $C_{22}$, preferably $C_{12}$ to $C_{18}$, with a mean value preferably in the $C_{12}$ to $C_{15}$ range. Especially preferred is PAS consisting wholly or predominantly of $C_{12}$ and $C_{14}$ material. However, if desired mixtures of different chain lengths may be used as described and claimed in EP 342 917A (Unilever).

The PAS may be straight-chain or branched-chain. Vegetable-derived PAS, especially PAS from coconut oil (coco-PAS), is especially preferred.. Use of branched-chain PAS as described and claimed in EP 439 316A (Unilever) is also within the scope of the invention.

PAS is preferably present in an amount of from 35 to 50 wt %. When the granular material of the invention is based on zeolite MAP, PAS may readily be incorporated in amounts of from 40 to 50 wt %.

As previously indicated, the invention is also applicable to alkylbenzene sulphonates (LAS), especially linear alkylbenzene sulphonates having an alkyl chain length of $C_8$ to $C_{15}$.

The loadings achievable with LAS are slightly lower than those achievable with PAS because, as discussed below, higher levels of carbonate are generally required in order to prepare the granules. LAS loadings are generally in the 33 to 45 wt % range, as compared with 23 wt % as specifically disclosed in EP 506 184A (Unilever).

Alkali Metal Carbonate

Alkali metal carbonate is an essential component of the granular material of the present invention, but is used at lower levels than in prior art granules. The preferred carbonate is sodium carbonate, but the invention also encompasses the use, for example, of potassium carbonate, sodium bicarbonate, and carbonate/bicarbonate mixtures.

Carbonate is present in an amount of from 2 to 25 wt %. When the anionic surfactant is LAS or LAS/PAS, the amount of carbonate is preferably from 5 to 20 wt % and more preferably from 10 to 20 wt %. When the anionic surfactant is PAS alone, the amount of carbonate can range from 2 to 12 wt %, preferably from 5 to 10 wt %.

In contrast, the Examples of EP 506 184A (Unilever) comprise a zeolite A/sodium carbonate/LAS granule containing 48 wt % carbonate to 18.7 wt % zeolite A and 23 wt % LAS, and four zeolite A/sodium carbonate/PAS granules containing 16–21 wt % carbonate to 34–39 wt % zeolite A and 25–32 wt % PAS.

In the preparation of the granules of the invention, the carbonate must always be present in the initial reaction mix in a greater than stoichiometric ratio to the surfactant acid in order to achieve a good neutralisation yield. As explained below, a larger excess is needed for LAS than for PAS because the neutralisation reaction requires it. The product thus always contains a certain proportion of carbonate.

The granular product will also contain a certain proportion of bicarbonate as a consequence of its method of preparation (in-situ neutralisation). The presence of a large excess of carbonate in the process promotes the formation of bicarbonate provided that efficient mixing takes place in the presence of water.

According to the present invention, it has been found possible to use smaller (excess) amounts of carbonate, while still achieving good neutralisation yields, and obtaining a granular non-friable free-flowing product. Reduction of the carbonate level reduces the alkalinity of the product and also leaves more formulation space for the surfactant and for the zeolite. This is of especial value when the zeolite is the highly absorbent zeolite MAP.

As previously mentioned, when the anionic surfactant present is PAS, the granular material of the invention preferably contains from 5 to 10 wt % of carbonate. In a granule based on zeolite MAP, the optimum carbonate level appears to be in the 5 to 7 wt % range, to give the optimum balance between powder properties (acceptable friability) and surfactant loading while still maintaining a sufficient reserve of alkalinity for the neutralisation process.

When the anionic surfactant present is LAS, the granular material of the invention preferably contains rather more carbonate, from 10 to 20 wt % apparently being optimum. This is a consequence of the in-situ neutralisation process, discussed in more detail below: a higher excess of carbonate is necessary than with PAS to achieve a sufficiently high neutralisation yield.

Other Ingredients

The granular detergent composition or component or the invention may further comprises minor amounts of one or more other detergent ingredients, for example, nonionic surfactants, water-soluble builder salts, fatty acids, fatty acid soaps, polycarboxylate polymers, sodium silicate and fluorescers. It is within the scope of the invention for such minor ingredients to be incorporated during the in-situ neutralisation process, so that they form part of the granular material itself.

The granular material may in turn be mixed with other ingredients to produce a more fully formulated product. For example, as indicated previously, nonionic surfactant and other liquid ingredients such as perfume may be sprayed on. Other particulate ingredients, for example, bleach ingredients, enzyme granules and foam-controlling granules, may be dry-mixed.

The Process

As indicated previously, the granular detergent composition or component of the invention may be prepared by a process which includes the step of continuously feeding a liquid precursor of the anionic surfactant (a), a greater than equivalent amount of alkali metal carbonate (c), sufficient water and/or alkali metal hydroxide solution for the neutralisation reaction, and zeolite (b), into a high-speed mixer/densifier, in amounts such that a composition or component as defined above is produced.

The process requires a high-speed mixer/densifier capable of continuous operation. Advantageously the mixer may comprise a hollow cylinder, mounted with its longitudinal axis in a substantially horizontal orientation, having therein an axial rotatable shaft with cutting and stirring blades mounted thereon. An example of such a mixer is the Lödige (Trade Mark) CB30 Recycler. This apparatus essentially consists of a large, static hollow cylinder having a diameter of about 30 cm which contains an axially mounted horizontal rotatable shaft carrying several different types of stirring and cutting blades. The shaft can be rotated at speeds of from 100 to 2500 rpm depending on the mixing intensity and particle size desired. Such a mixer provides a high energy stirring input and achieves very thorough mixing of both liquids and solids in a very short time. For larger scale operation, the CB50 Recycler with a 50 cm diameter cylinder is suitable.

Advantageously, the granular material of the invention is prepared by the single-step procedure described and claimed in EP 506 184A (Unilever), already discussed. In that process, as applied to the present invention, 20–45 wt % of the liquid anionic surfactant acid precursor, a greater than equivalent amount of alkali metal carbonate, a suitable amount of water and/or alkali metal hydroxide solution, plus a suitable amount of zeolite, are fed into a high-speed mixer/densifier, the mean residence time being from 5 to 30 seconds and the moisture content of the powder in the mixer being from 5 to 15 wt %, preferably from 8 to 12 wt %.

Water is essential in order to initiate and drive the neutralisation reaction. With PAS, the reaction proceeds rapidly and readily. The neutralisation of LAS, however, is more difficult and requires the presence of alkali metal, preferably sodium, hydroxide solution. A larger excess of carbonate in the initial reaction mix is also generally needed than is the case with PAS, so that the final product cannot have as low a carbonate content as is possible for a PAS-based granule.

The process as described and claimed in EP 506 184A (Unilever), however, requires only a low level of water compared with previously known processes. When this process is used to make the granular materials of the invention, the products that emerge from the high-speed mixer are hot (typically above 90° C.), and can then be very efficiently dried to a low moisture content, preferably a moisture content corresponding to a relative ]humidity value (of air at 1 atm and 20° C. in equilibrium with the composition) not exceeding 30%, more preferably not exceeding 20%. This combined cooling and drying step may conveniently be carried out using a fluidised bed in which the fluidising gas is cold dry air.

EXAMPLES

The invention is further illustrated by the following non-limiting Examples, in which parts and percentages are by weight unless otherwise stated.

EXAMPLES 1 To 4

Zeolite A/PAS/Sodium Carbonote Granules

Granular materials containing zeolite 4A, PAS and sodium carbonate was prepared to the following formulations:

| | 1 | 2 | 3 | 4 |
|---|---|---|---|---|
| Na cocoPAS | 40.3 | 39.8 | 39.5 | 39.8 |
| Zeolite 4A | 42.8 | 39.0 | 38.4 | 35.7 |
| Na carbonate | 2.9 | 7.2 | 8.1 | 11.4 |
| Water and salts | 14.1 | 14.1 | 14.0 | 14.2 |
| | 100.0 | 100.0 | 100.0 | 100.0 |

The zeolite 4A was Wessalith (Trade Mark) P ex Degussa, and the PAS was derived from Laurex (Trade Mark) natural coconut ($C_{12}$-$C_{14}$ straight chain) alcohol.

The granular material was prepared by a continuous process in the Lödige CB30 Recycler, the raw materials fed into the Recycler being zeolite 4A, sodium carbonate, PAS acid and water. The products left the Recycler at a temperature of 70°–90° C. and were cooled and dried in a fluidised bed using ambient (25°–30° C.) air. The granular products were white and all had bulk densities of 650 g/liter or above, and dynamic flow rates above 100 ml/s.

Mean particle sizes (Dm) and content of fines (particles ≦180 micrometers) were as shown below. Also shown are values for the attrition (increase in fines) after 10 minutes in a spouted fluidised bed.

| Example | 1 | 2 | 4 |
|---|---|---|---|
| Dm (micrometers) | 564 | 674 | 1270 |
| Fines (wt %) | 14.9 | 9.9 | 5.2 |
| Attrition (wt %) | 9.8 | 9.8 | 9.2 |

EXAMPLES 5 to 8

Zeolite MAP/PAS/Sodium Carbonate Granules

Granular materials containing zeolite MAP, PAS and sodium carbonate was prepared to the following formulations:

| | 5 | 6 | 7 | 8 |
|---|---|---|---|---|
| Sodium cocoPAS | 44.3 | 45.6 | 44.4 | 44.4 |
| Zeolite MAP (anhydr) | 35.4 | 35.0 | 33.3 | 30.8 |
| Sodium carbonate | 6.3 | 8.0 | 8.2 | 10.7 |
| Water and salts | 14.0 | 11.4 | 14.4 | 14.1 |
| | 100.0 | 100.0 | 100.0 | 100.0 |

The zeolite MAP was prepared by a method similar to that described in EP 384 070A (Unilever). The PAS was as in Example 1.

The granular materials were prepared by the continuous process used in Example 1.

The materials leaving the Recycler were free-flowing granules having bulk densities of 650 g/liter or above and dynamic flow rates greater than 100 ml/s. Mean particle sizes (Dm), fines and attrition values were as shown below.

| | 7 | 8 |
|---|---|---|
| Dm (micrometers) | 520 | 649 |
| Fines (wt %) | 18.7 | 11.2 |
| Attrition (wt %) | 14.0 | 8.9 |

Dissolution

The dissolution rates (time for 90 wt % dissolution of the ionic material) of the granules of Examples 3 and 5 under various conditions were compared. All tests were carried out in a 200 ml beaker with stirring. The rates of dissolution of the surfactant and associated salts were compared using a WTW E3000 ionic strength meter.

| | Example 3 (zeolite A) | Example 5 (zeolite MAP) |
|---|---|---|
| Water (9° FH.) at 20° C. | 110 s | 90 s |

-continued

| | Example 3 (zeolite A) | Example 5 (zeolite MAP) |
|---|---|---|
| 5 g/l sodium citrate solution at 20° C. | 160 s | 110 s |
| Water (9° FH.) at 40° C. | 55 s | 40 s |

EXAMPLES 9 to 11

LAS/Zeolite MAP/Sodium Carbonate Granules

By a process similar to that used for the PAS-based granules of previous examples, granular materials were prepared to the following formulations:

| | 9 | 10 | 11 |
|---|---|---|---|
| Sodium LAS | 35.0 | 41.4 | 38.2 |
| Zeolite MAP (anhydrous) | 38.0 | 36.6 | 45.2 |
| Sodium carbonate | 19.0 | — | 7.8 |
| Sodium carbonate/bicarbonate | — | 11.5 | — |
| Water and salts | 8.0 | 10.5 | 8.8 |
| | 100.0 | 100.0 | 100.0 |

The granular materials were prepared by continuous processing in the Lödige CB30 Recycler. The raw materials fed into the Recycler were zeolite MAP powder, sodium carbonate (or sodium carbonate plus bicarbonate), LAS acid (Dobanic (Trade Mark) 103 Acid ex Shell), and sodium hydroxide solution (48.5 wt %).

To prepare the granule of Example 11 the ingredients were fed into the Recycler in the following amounts:

| | kg/h |
|---|---|
| LAS acid | 447 |
| NAOH 48.5% | 69 |
| Zeolite A24 powder | 630 |
| Na carbonate | 141 |

All the granular materials were free-flowing and had bulk densities in the 550–800 g/liter range.

Detailed properties of two samples of the material of Example 11 were as follows:

| | 11(1) | 11(2) |
|---|---|---|
| Bulk density (g/l) | 719 | 769 |
| Dynamic flow rate (ml/s) | 142 | 136 |
| Average particle size: | | |
| Rosin-Rammler Dp (micrometers) | 710 | 520 |
| Rosin-Rammler N | 1.8 | 2.0 |
| Fine particles <180 micrometers (wt %) | 5 | 8 |
| Coarse particles >1400 micrometers (wt %) | 6 | 3 |
| Attrition (wt %) | 6 | 8 |
| Relative humidity 20° C. (%) | 10.4 | 9.8 |

We claim:

1. A free-flowing granular detergent component having a bulk density of at least 550 g/liter consisting essentially of:

(a) from 40 to 50 wt % of primary alcohol sulphate, (b) from 30 to 50 wt % (anhydrous basis) of zeolite, (c) from 2 to 12 wt % of sodium carbonate, wherein the detergent component has a moisture content corresponding to relative humidity of air at 1 atm and 20° C.

in equilibrium With the composition not exceeding 30 wt. %.

2. A detergent component as claimed in claim 1, which contains from 5 to 10 wt % sodium carbonate.

3. A detergent component as claimed in claim 1, wherein the zeolite (b) comprises zeolite P having a silicon to aluminium ratio not exceeding 1.33 (zeolite MAP).

4. A detergent component as claimed in claim 1, having a bulk density of from 550 to 800 g/liter.

5. A free-flowing granular detergent component having a bulk density of at least 550 g/liter consisting essentially of:

(a) from 33 to 45 wt % of alkylbenzene sulphonate, (b) from 30 to 50 wt % (anhydrous basis) of zeolite, (c) from 2 to 25 wt % of sodium carbonate, wherein the detergent component has a moisture content corresponding to relative humidity of air at 1 atm and 20° C. in equalibrium with the composition not exceeding 30 wt. %.

6. A detergent component as claimed in claim 5, which contains from 10 to 20 wt % sodium carbonate.

* * * * *